US005410128A

United States Patent [19]

Vermillion et al.

[11] Patent Number: 5,410,128

[45] Date of Patent: Apr. 25, 1995

[54] HOLD DOWN SPRING CLIP FOR ELECTRIC RANGE COIL TYPE HEATING ELEMENTS

[76] Inventors: Raymond L. Vermillion, 666 Lakeside Dr.; Larry L. Keefover, 202 Bell La., both of Springfield, Tenn. 37172; Harvey F. Brooks, 674 Windsor Green Blvd., Goodlettsville, Tenn. 37072

[21] Appl. No.: 176,806

[22] Filed: Jan. 3, 1994

[51] Int. Cl.[6] ..... H05B 3/76

[52] U.S. Cl. ..... 219/467; 219/463

[58] Field of Search ..... 219/467, 468, 455, 463; 403/397

[56] References Cited

U.S. PATENT DOCUMENTS

| | | | |
|---|---|---|---|
| 2,725,456 | 11/1955 | Weyrick | 219/467 |
| 2,839,655 | 6/1958 | Price . | |
| 2,839,656 | 6/1958 | Weyrick . | |
| 3,016,445 | 1/1962 | Lien, Jr. . | |
| 3,116,400 | 12/1963 | McOrlly . | |
| 3,172,995 | 3/1965 | Kirschke et al. . | |
| 3,227,856 | 1/1966 | Hurko et al. . | |
| 3,258,580 | 6/1966 | Dills . | |
| 3,373,261 | 3/1968 | Filipak | 219/463 |
| 3,613,177 | 10/1971 | Davis . | |
| 3,885,128 | 5/1975 | Dills | 219/462 |
| 4,261,327 | 4/1981 | Kamin . | |
| 4,906,819 | 3/1990 | Thompson | 219/467 |
| 4,974,804 | 12/1990 | Thompson et al. | 248/316.7 |
| 4,988,149 | 1/1991 | Mulder et al. | 312/223 |
| 5,153,414 | 10/1992 | Wilson et al. | 219/467 |

*Primary Examiner*—Teresa J. Walberg

[57] ABSTRACT

A heating element assembly is provided in an opening in a top panel of an electric range. The heating element assembly includes a drip pan, a coil-type heating element, a multi-legged spider, and a spring clip. Opposite ends of the spring clip are received by apertures provided in the drip pan. The spring clip has a resiliently displaceable portion that engages an end surface of a spider leg to releasably secure the spider and heating element to the drip pan.

12 Claims, 3 Drawing Sheets

HOLD DOWN SPRING CLIP FOR ELECTRIC RANGE COIL TYPE HEATING ELEMENTS

BACKGROUND OF THE INVENTION

The present invention generally relates to coil type heating element assemblies for use in electric ranges, and more specifically, to such assemblies having a hold down spring clip to secure the heating element to an underlying drip pan.

An electric range generally has a main top panel which provides a plurality of circular openings. A drip pan having an outer flange is positioned within each circular opening such that the outer flange rests upon the top panel and supports the drip pan within the opening. A coil type heating element of the electrical resistance type is supported and retained within the drip pan by a multi-legged support member or "spider" attached to the underside of the heating element. Any substance which falls through the coil heating element and underlying spider is contained within the drip pan.

It is necessary to remove the heating element to clean the drip pan. With plug-in type heating elements this can be easily accomplished. However, after repeated removal and installation, the looped ends of the heating element, which plug into a receptacle, tend to wear or deform. When the heating element is installed with worn or deformed looped ends the heating element does not lay flat or horizontal within the drip pan. The heating element can be angled upward from the looped ends or twisted about the looped ends. The heating element remains in this undesired position until the looped ends are again deformed to allow heating element to lay in a horizontal position. This often occurs when a pot or pan with sufficient weight is placed on the heating element.

Means to hold down the heating element utilizing spring members are known in the prior art. For example, U.S. Pat. No. 2,839,655 discloses a spider leg having a tab which is received within an opening in the side of a trim ring. A helical coil spring is attached to the range top platform opposite the opening in the trim ring and biases the heating element toward the opening to releasably retain the tab within the opening. The heating element is moved against the spring bias to release or remove the tab from the opening. See also U.S. Pat. Nos. 3,373,261, 3,016,445, and 2,839,656 for related heating element mounting arrangements wherein a spring element biases a spider into an opening in the trim ring or drip pan. U.S. Pat. Nos. 5,153,414, 3,258,580, and 3,116,400 also disclose positioning or hold down means wherein an end of the spider extends through an aperture in the trim ring or drip pan.

U.S. Pat. Nos. 4,974,804 and 4,906,819 describe a hold down clip that is attached to the range top and has two upwardly extending spring arm members which project through an opening in the bowl. The spring clip is attached to the range top by a fastener and secures one of the spider legs of the heating element to the range top. The spider leg is gripped on opposite sides by the opposing spring arms of the clip. After repeated removal and installation, and the effect of repeated heating and cooling, the spring clip may tend to lose gripping strength as the spring arm members and the spider leg wear. This spring clip also suffers from the disadvantage that it must be installed with separate fasteners, which increase the cost and time to manufacture the appliance.

U.S. Pat. Nos. 3,227,856 and 3,172,995 disclose heating elements which provide spring members that engage the sidewall surrounding the circular recess in which the heating element is placed. The spring members are operable to center the heating element within the recess.

U.S. Pat. No. 4,261,327 discloses a spring clip mounted in the gas range top to receive projections that extend downwardly from a burner grate. The spring clip engages opposite sides of the projections and thereby releasingly holds the grate in place. U.S. Pat. No. 3,885,128 discloses a spring clip mounted in the range top to hold a trim ring in place. Neither of these spring clips hold the heating element in place.

The aforementioned prior art hold down means attach the spring member to the range top resulting in multiple assemblies and an increased number of parts. Some prior art hold down means are ineffective after repeated use. In either case the result is unsatisfactory. Therefore, there is a need in the art for an improved heating element hold down means. Moreover, there is a need in the art for a heating element hold down means which attaches to the drip pan and does not require separate fasteners.

SUMMARY OF THE INVENTION

The present invention provides an electric coil type heating element assembly that solves the problem of the heating element not laying flat in the drip pan. The disadvantages of the prior art are overcome by providing a detent means which is mounted to the drip pan without fasteners.

According to the invention, there is provided a drip pan having an outer flange that supports the drip pan in a circular opening in a top panel of an electric range. A support is arranged in the drip pan for supporting the heating element above the drip pan. In the preferred embodiment, the support comprises a multi-legged spider defining a top planar support surface for the heating element and a bottom planar surface which engages and is vertically supported by the drip pan. A detent means mounted to the drip pan is provided to releasably secure the heating element to the drip pan by retaining the support means. In the preferred embodiment, the detent means comprises a spring clip having a displaceable portion for releasably engaging and securing a leg of the spider to the drip pan. The drip pan defines apertures through which opposite ends of the spring clip extend to mount the spring clip to the drip pan.

By securing the detent means directly to the drip pan, the heating element, support means, drip pan, and detent means are one assembly. Additionally, by securing the detent means to the drip pan without independent fasteners, the total quantity of parts is minimized and the time and labor required for assembly is reduced.

BRIEF DESCRIPTION OF THE DRAWINGS

The present invention will hereafter be described with reference to the drawing figures, wherein.

DETAILED DESCRIPTION OF THE PREFERRED EMBODIMENT

Figure 1:
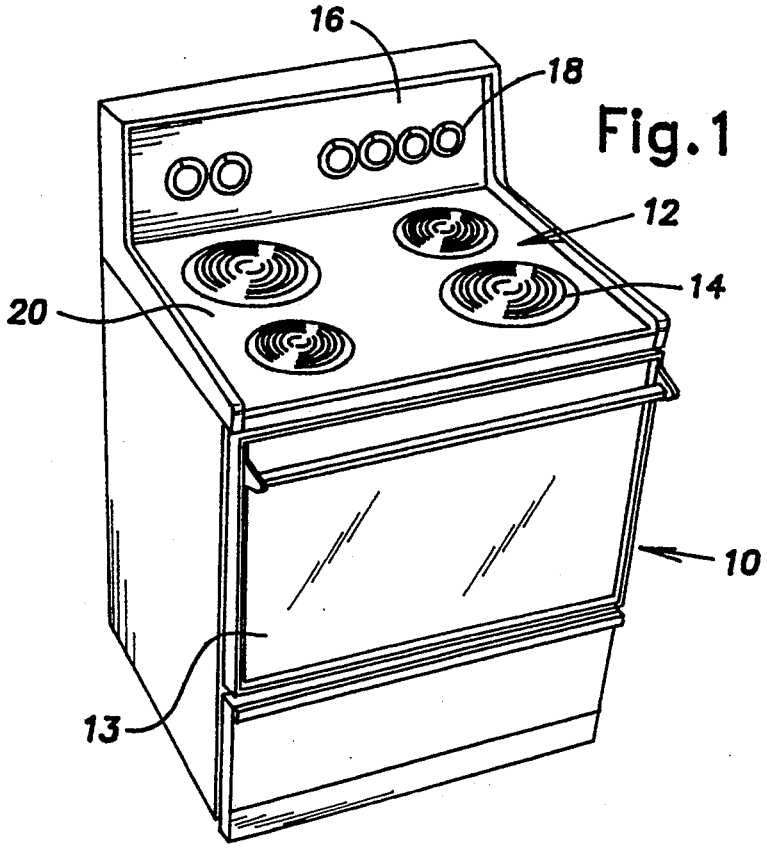
FIG. 1 is a perspective view of an electric range.

An electric range 10 is shown in FIG. 1 having a cabinet including a top cooking surface 12 and a front opening which is closed by a door 13 hingedly mounted for pivotal movement about its bottom edge, as is conventional. The top cooking surface 12 provides a top panel 20 which defines a series of openings 22 in which is secured a like number of electric coil type heating element assemblies 14. FIG. 1 illustrates two large and two small heating element assemblies 14, however, any quantity or combination of sizes could be utilized. A rear console 16 contains control means such as knobs 18 which control the heating element assemblies 14. Each heating element assembly 14 consists of a resistance-type heating element 24, a multi-legged spider 50, a drip pan 32, and a hold down spring clip 60, as shown in more detail in FIGS. 2–6.

Figure 5:
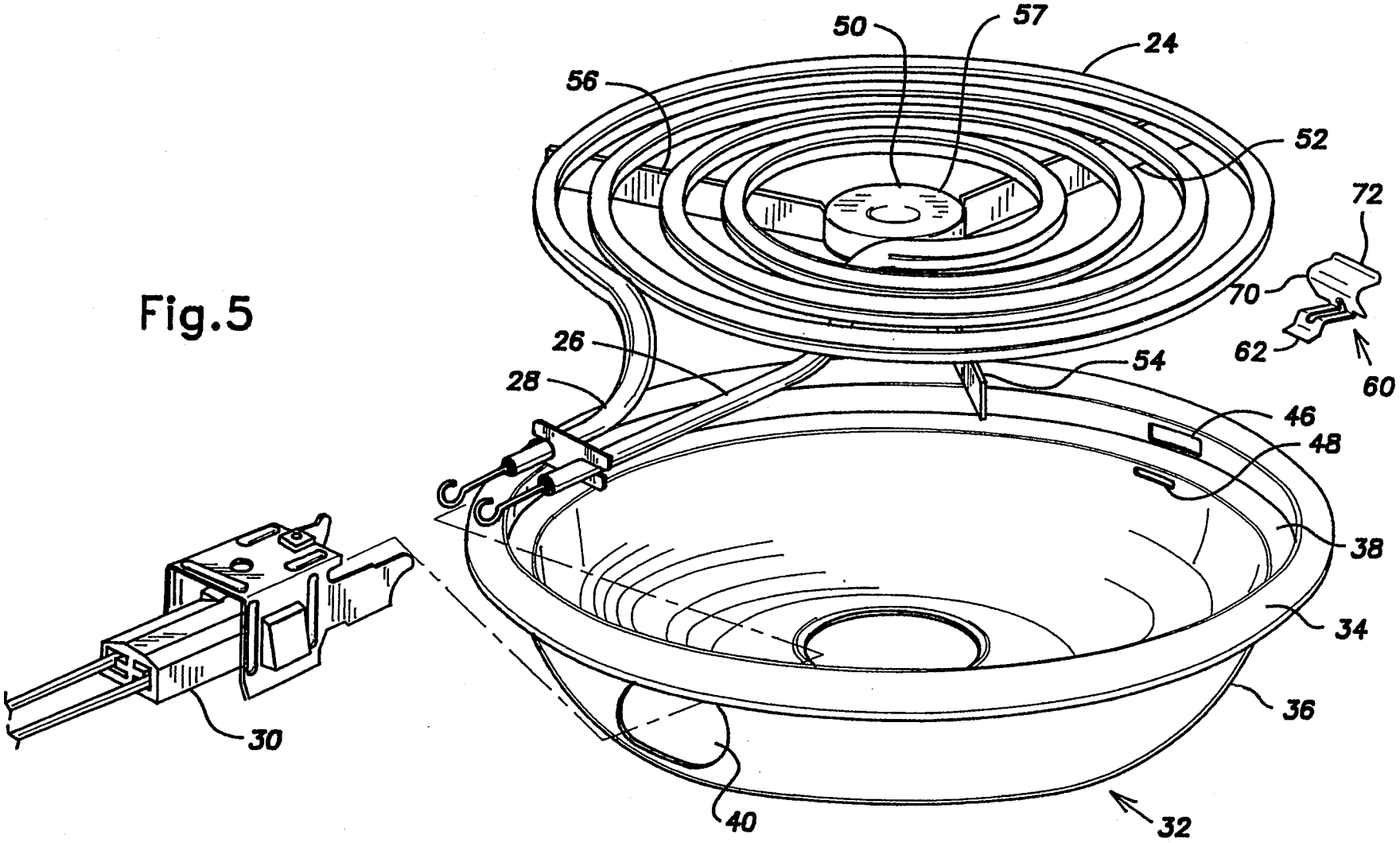
FIG. 5 is an exploded perspective view of the heating element assembly.

The heating element 24 has a first end section 26 and a second end section 28. Intermediate the two end sections 26, 28 is a spirally-coiled section which defines a planar top surface. The end sections 26, 28 extend downwardly from the coiled section and then outwardly, substantially parallel to each other as illustrated in FIG. 5. Because the first end section 26 extends from the center or inner portion of the coiled section and the second end section 28 extends from the outer radius of the coiled section, the first end section 26 is longer than the second end section 28.

The end sections 26, 28 extend through an opening 40 in the drip pan 32. An electrical receptacle 30 is secured beneath the top panel 20 of the range 10 into which the two end sections 26, 28 of the heating element 24 are plugged. The receptacle 30 is generally well known in the art and will not be described more fully herein. U.S. Pat. No. 4,381,444, the disclosure of which is incorporated herein in its entirety, should be consulted for more information on such receptacle.

Figure 2:
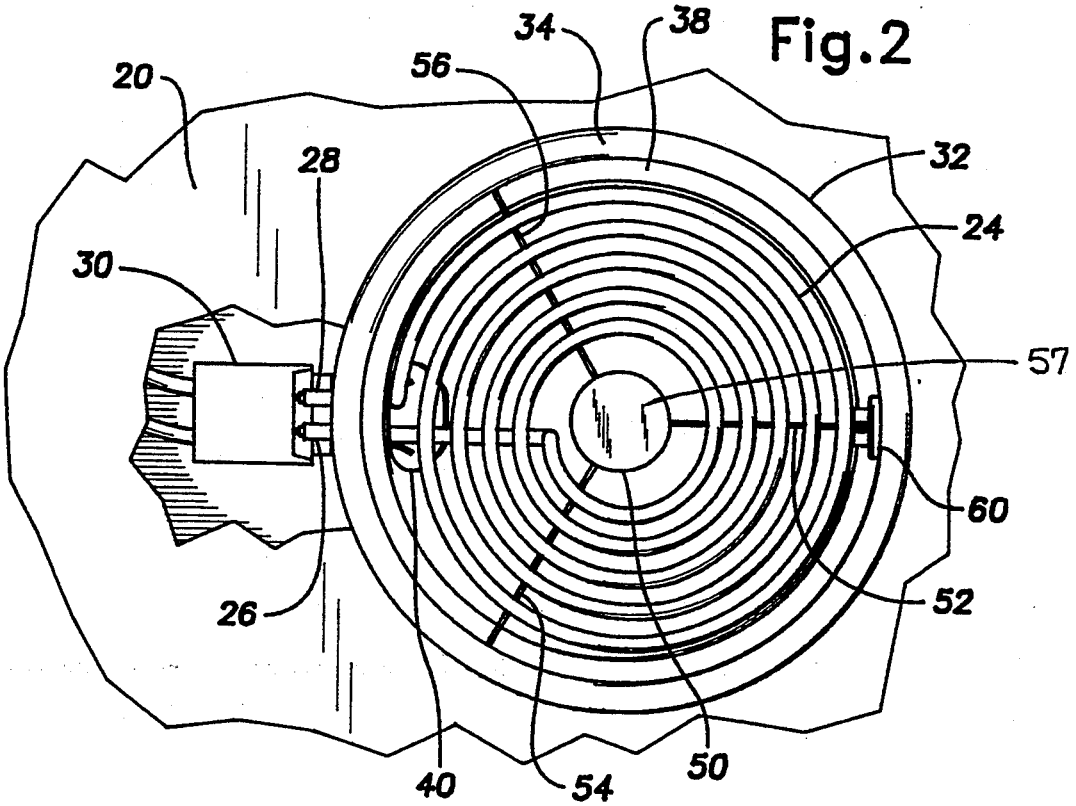
FIG. 2 is a plan view of a heating element assembly mounted to a top cooking surface of the electric range.
Figure 3:
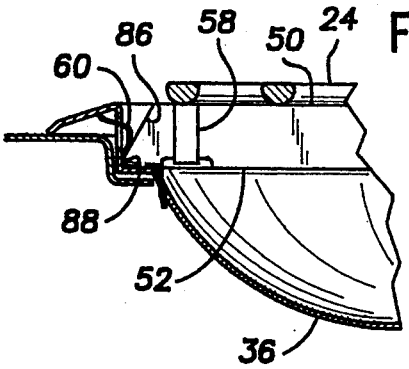
FIG. 3 is an elevational view, in cross section, of the heating element assembly of FIG. 2.
Figure 8:
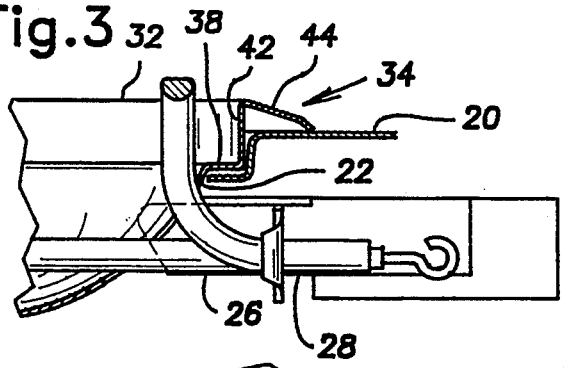
FIG. 8 is a elevational view, partially in cross section, of the spring clip engaged with the first spider leg.
Figure 4:
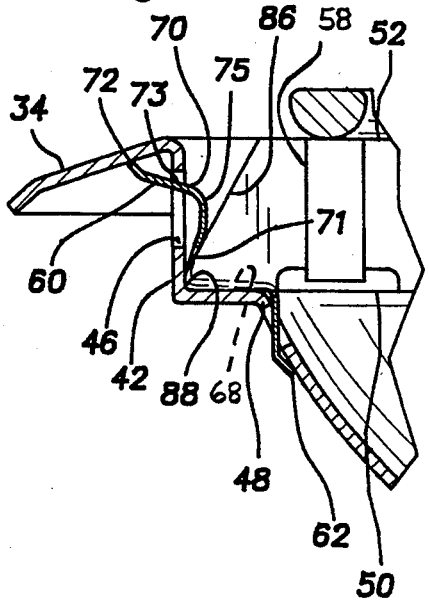
FIG. 4 is a fragmentary plan view of the spider and spring clip.
Figure 4:
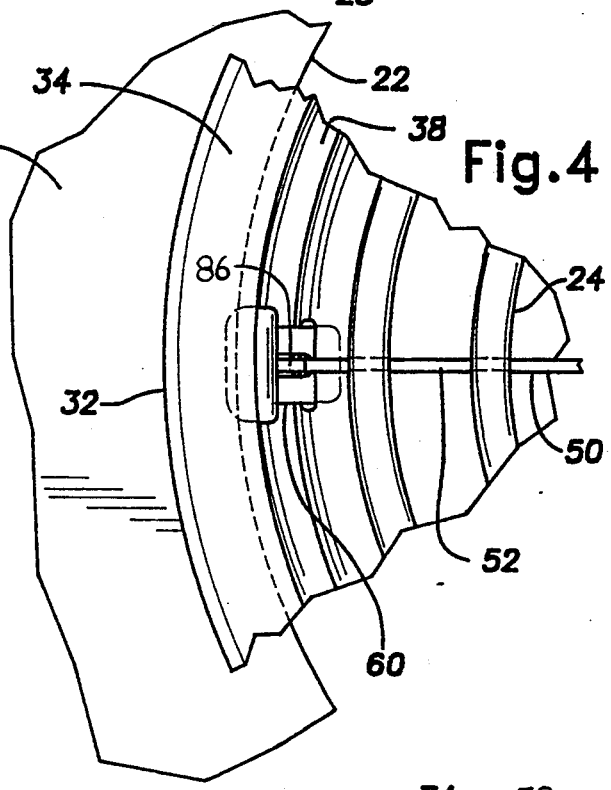

As shown in FIG. 2, the heating element 24 is supported within the drip pan 32 by the multi-legged spider 50. The spider 50 has first, second, and third legs 52, 54, 56 which are 120 degrees to each other and attach to a central circular member 57. The legs 52, 54, 56 define a top planar surface which supports the heating element 24, and a bottom planar surface upon which the spider rests in the drip pan 32. In at least one location the heating element 24 is secured to the spider 50 by a strap 58, as shown in FIG. 3, to prevent movement of the heating element 24 relative to the spider 50. The first leg 52 is preferably located directly opposite the drip pan opening 40. The first leg 52 has an angled end surface 86 with a rounded bottom corner 88 adapted to engage and be removably secured to the drip pan 32 by the spring clip 60 as seen in FIG. 8.

The drip pan has a central bowl portion 36, a circumferential outer flange 34, and horizontal annular ledge 38. The drip pan 32 is positioned within one of the circular openings 22 in the top panel 20 such that the central bowl portion 36 extends below the top panel 20 as shown in FIG. 3. The outer flange 34 rests upon the top panel 20 adjacent the circular opening 22 and thereby vertically supports the drip pan 32 within the opening 22. The outer flange 34 consists of a vertical portion 42 which extends upwardly from an outer edge of the annular ledge 38 and an angled portion 44 which extends outwardly and downwardly from the top of the vertical portion 42. The outer ends of the spider legs 52, 54, 56 rest upon and are supported by the horizontal annular ledge 38. Opposite the drip pan opening 40, the bowl portion 36 provides a lower aperture 48 and the vertical portion 42 of the outer flange 34 provides an upper aperture 46.

Figure 6:
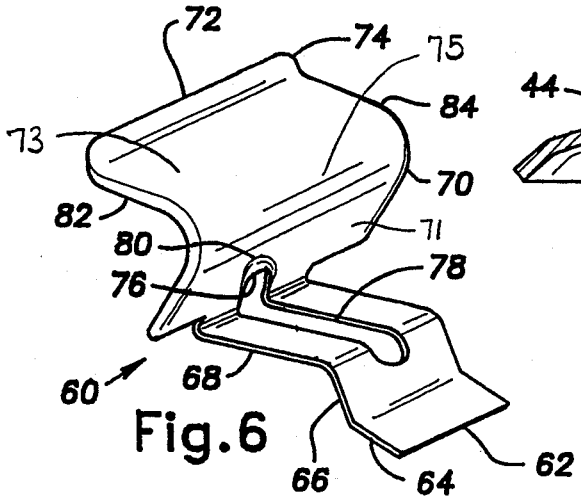
FIG. 6 is a perspective view of the spring clip.

As shown in FIG. 6, the hold down spring clip 60 has a first or lower end 64 which provides a bottom lip 62. An angled portion 66 extends upwardly from the bottom lip 64 and is formed to match the shape or curvature of the bowl portion 36 of the drip pan 32 between the lower aperture 48 and the annular ledge 38. A substantially horizontal or planar portion 68 extends from the angled portion 66 and merges with an upwardly projecting curved or displaceable portion 70 which provides a second or upper end 74 of the spring clip 60. The second end 74 has a top lip 72 which extends from the curved portion 70. In the preferred embodiment, the curved portion 70 has rolled edges 82, 84 to prevent objects from being snagged when the drip pan 32 is being cleaned.

An elongated slot 78 is located in the horizontal portion 68 of the spring clip 60 and extends downwardly a short distance into the angled portion 66 and upwardly a short distance into the curved portion 70. A tapered groove 80 is formed in the curved portion 70 at the upper edge 76 of the elongated slot 78 in the spring clip 60. The tapered groove 80 is deepest at the upper edge 76 of the elongated slot 78 and the depth gradually decreases upwardly until the tapered groove 80 blends into the curved portion.

The tapered groove is sized to receive the angled end surface 86 and bottom rounded corner 88 of the first spider leg 52. The elongated slot 78 is sized to receive or contain a bottom portion of the first spider leg 52. As such, the width of the elongated slot 78 is only slightly larger than the width of the first spider leg 52 in order to limit horizontal movement of the spider 50 within the drip pan 32. In order to further limit the horizontal movement of the spider 50, the width of the upper aperture 46 and lower aperture 48 are only slightly larger than the width of the curved portion 70 and angled portion 66 respectively.

The hold down spring clip 60 is mounted to the drip pan 32 radially opposite the drip pan opening 40, as illustrated in FIG. 2. With reference to FIGS. 3, 5, 6, and 8, the first end 64 of the spring clip 60 is restrained by the lower aperture 48 formed in the bowl portion 36 of the drip pan 32 below the annular ledge 38 while the second end 74 of the spring clip 60 is restrained by an upper aperture 46 formed in the vertical portion 42 of the outer flange 34 of the drip pan 32.

The spring clip 60 is specifically sized and dimensioned to attach to the drip pan 32 and to receive the first spider leg 50, as illustrated. The bottom lip 62 engages the drip pan 32 at a location downwardly adjacent the lower aperture 48 while the angled portion 66 extends inwardly and upwardly through the lower aperture 48 and is shaped to generally match the contour of the bowl portion 36 of the drip pan 32 between the lower aperture 48 and the annular ledge 38. The horizontal portion 68 lies upon the annular ledge 38 while the curved portion 70 extends therefrom. A lower section 71 of the curved portion 70 extends inwardly and upwardly from the horizontal portion 68 while an upper section 73 extends outwardly and upwardly, as illustrated, the intersection of the upper and lower sections 73, 71 defining an apex 75 of the curved portion 70.

The curved portion 70 is formed and dimensioned to match the width and height of the upper aperture 46 through which the curved portion 70 outwardly extends. The top lip 72 of the second end 74 is provided at the end of the curved portion 70 and is adjacent the under side of the outer flange 34 upwardly adjacent the upper aperture 46.

Figure 7:
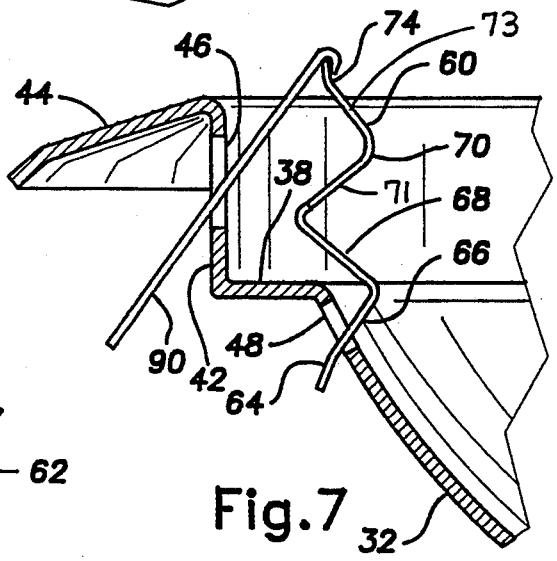
FIG. 7 is an elevational view, partially in cross section of a tool installing the spring clip within the drip pan.

As shown in FIG. 7, the spring clip 60 is installed in the drip pan 32 by a tool 90 which can be any elongated instrument with a hooked end. The bottom lip 62 of the spring clip 60 is inserted inwardly through the lower aperture 48 of the drip pan 32 and engages an outer surface thereof. The tool 90 is inserted through the upper aperture 46 of the drip pan 32 and hooked over the top lip 72 of the spring clip 60. The tool 90 is then pulled downwardly and outwardly until the top lip 72 of the spring clip 60 passes through the upper aperture 46. When the tool 90 releases the spring clip 60, the curved portion 70 extends through the upper aperture 46 and the top lip 72 is positioned adjacent the outer surface of the drip pan 32.

To insert the heating element 24 into the drip pan 32, the heating element 24 is presented at an angle to allow insertion of the element end sections 26, 28 through the opening 40 in the drip pan 32 and into the receptacle 30. The heating element 24 is then pivoted downwardly until the bottom rounded corner 88 of the first spider leg 52 engages the upper section 73 of the spring clip curved portion 70. As the heating element continues to move downwardly, the rounded corner 88 rides downwardly against the upper section 73 of the curved portion 70, and forces the curved portion 70 downwardly and outwardly through the upper aperture 46.

Because the spring clip 60 is made of a resilient metal material, such as spring steel, when the rounded corner 88 passes the apex 75 of the curved portion 70 the spring clip 60 resiliently snaps-back toward its original or at-rest position and thereby forces the first spider leg 52 downwardly against the annular ledge 38. More specifically, as the rounded corner 88 passes the apex 75 of the spring clip curved portion 70, the angled end surface 86 engages the lower section 71 of the curved portion 70 and the first spider leg 52 is forced downwardly as the lower section 71 rides along the end surface 86 and the spring clip 60 springs inwardly and upwardly toward its original or at-rest position.

When the bottom rounded corner 88 passes under the curved portion 70, it is received by the tapered groove 80 and fed into the elongated slot 78 until the bottom portion of the first spider leg 52 rests on the annular ledge 38 of the drip pan 32. The second and third spider legs 54, 56 likewise rest upon the annular ledge 38. The curved portion 70 applies a downward force on the spider first leg 52 to secure it to the drip pan 32 and thereby prevent the spider 50 from freely moving vertically.

When the heating element 24 is to be removed, an upward force is applied to the heating element 24 adjacent to the spring clip 60 to overcome the spring force of the spring clip 60. As the heating element 24 is moved upwardly, the angled end 86 of the first spider leg 52 rides upwardly against the curved portion lower section 71 and cams the curved portion 70 outwardly and downwardly through the upper aperture 46. When the rounded bottom corner 88 passes the apex 75 of the curved portion 70, the spring clip 60 resiliently snaps back to its original or at-rest position and releases the first spider leg 52. More specifically, as the rounded corner 88 passes the apex 75 of the spring clip curved portion 70, the first spider leg 52 is forced upwardly by the upper section 73 as the spring clip resiliently springs inwardly and upwardly to its original or at-rest position. The heating element 24 is thereafter further pivoted upwardly until the end sections 26, 28 are removed from the receptacle 30 and the heating element 24 is raised free of the drip pan 32. When desired, the heating element 24 can be reinstalled in the above-described manner.

Although a particular embodiment of a heating element assembly has been described in detail, it will be understood that the invention is not limited correspondingly in scope, but includes all changes and modifications coming within the spirit and terms of the claims appended hereto.

What is claimed is:

1. A heating element assembly for an electric range, said assembly being supported within an opening in a top panel of the electric range and comprising a heating element, a pan positioned within said opening and having an outer flange to support said pan on said top panel and an annular ledge portion, a a multi-legged spider member arranged in said pan and supported by said annular ledge portion to support said heating element above said pan, and detent means mounted to said pan removably blocking upward movement of said multi-legged spider member, one leg of said multi-legged spider member having an angled end surface which is engaged by said detent means to removably secure said heating element to said pan.

2. The heating element assembly according to claim 1, wherein said one leg further comprises a rounded corner at a bottom of said angled end surface, said rounded corner being received within a groove provided by said detent means.

3. The heating element assembly according to claim 1, wherein said detent means comprises a spring clip having a resiliently displaceable portion for releasably securing said one leg of said spider member to said pan.

4. The heating element assembly according to claim 3, wherein said pan defines two apertures, said spring clip further comprising portions arranged to extend through the two apertures for mounting said spring clip to said pan.

5. The heating element assembly according to claim 3, wherein said spring clip further comprises a substantially planar portion adjacent said displaceable portion, said planar portion defining an opening through which said one leg extends.

6. The heating element assembly according to claim 5, wherein said spring clip further comprises a tapered groove at an upper edge of said opening, said groove receiving and end of said one leg.

7. A heating element assembly for an electric range to be supported within an opening in a top panel of the electric range, said heating element assembly comprising a coiled resistance-type heating element, a drip pan to be positioned within said opening, a multi-legged spider, and a spring clip, said drip pan having an outer flange for supporting the pan on the top panel an inner annular ledge portion supporting the multi-legged spider, said spider being secured to and supporting the heating element, said spring clip being mounted to the pan and comprising a displaceable portion which engages and end surface of one leg of said multi-legged spider to block upward movement of said multi-legged spider member and releasably secure said spider and heating element to said pan.

8. The heating element assembly according to claim 7, wherein said end surface is angled and radially deforms the spring clip during installation.

9. The heating element assembly according to claim 8, wherein said one leg further comprises a rounded corner at a bottom of said angled end surface, said rounded corner being received by a tapered groove provided by said spring clip.

10. The heating element assembly according to claim 7, wherein said pan defines two apertures, said spring clip further comprising portions arranged to extend through the two apertures to mount said spring clip to said pan.

11. The heating element assembly according to claim 7, wherein said spring clip further comprises a substantially planar portion adjacent said displaceable portion, said planar portion defining an opening through which said one leg extends.

12. The heating element assembly according to claim 11, wherein said spring clip further comprises a tapered groove at an upper edge of said opening.

* * * * *

UNITED STATES PATENT AND TRADEMARK OFFICE

CERTIFICATE OF CORRECTION

PATENT NO. : 5,410,128

DATED : April 25, 1995

INVENTOR(S) : Raymond L. Vermillion et al.

It is certified that error appears in the above-indentified patent and that said Letters Patent is hereby corrected as shown below:

On the title page, the following information should be inserted with respect to the assignee: --White Consolidated Industries, Inc., Cleveland, Ohio--.

On the title page, the following information should be inserted with respect to the Attorney, Agent or Firm: --Pearne, Gordon, McCoy & Granger--.

Signed and Sealed this

Nineteenth Day of March, 1996

Bruce Lehman

*Attest:*

BRUCE LEHMAN

*Attesting Officer*

*Commissioner of Patents and Trademarks*